US012729344B2

(12) United States Patent
Jo et al.

(10) Patent No.: US 12,729,344 B2
(45) Date of Patent: Sep. 8, 2026

(54) PYROLYSIS METHOD FOR WASTE PLASTIC

(71) Applicant: SK INNOVATION CO., LTD., Seoul (KR)

(72) Inventors: Sanghwan Jo, Daejeon (KR); Jaeheum Jung, Daejeon (KR); Sookil Kang, Daejeon (KR)

(73) Assignee: SK INNOVATION CO., LTD., Seoul (KR)

( * ) Notice: Subject to any disclaimer, the term of this patent is extended or adjusted under 35 U.S.C. 154(b) by 169 days.

(21) Appl. No.: 18/701,625

(22) PCT Filed: Oct. 20, 2022

(86) PCT No.: PCT/KR2022/016038
§ 371 (c)(1),
(2) Date: Apr. 16, 2024

(87) PCT Pub. No.: WO2023/068842
PCT Pub. Date: Apr. 27, 2023

(65) Prior Publication Data

US 2024/0409823 A1 Dec. 12, 2024

(30) Foreign Application Priority Data

Oct. 20, 2021 (KR) ..... 10-2021-0140266

(51) Int. Cl.
*C10G 29/16* (2006.01)
*C10G 29/04* (2006.01)

(52) U.S. Cl.
CPC ..... *C10G 29/16* (2013.01); *C10G 29/04* (2013.01); *C10G 2300/1003* (2013.01); *C10G 2300/202* (2013.01); *C10G 2300/301* (2013.01); *C10G 2300/4006* (2013.01)

(58) Field of Classification Search
CPC ..... C10G 29/16; C10G 29/04; C10G 2300/1003; C10G 2300/202; C10G 2300/301; C10G 2300/4006; C10G 1/002; C10G 29/00; C10G 31/09; C10G 1/10; C10G 2300/201
See application file for complete search history.

(56) References Cited

U.S. PATENT DOCUMENTS

| | | | |
|---|---|---|---|
| 5,904,879 | A | 5/1999 | Winter et al. |
| 2015/0080624 | A1 | 3/2015 | Gephart et al. |
| 2021/0108154 | A1 | 4/2021 | Scheibel et al. |
| 2021/0269721 | A1 | 9/2021 | Fareid et al. |

FOREIGN PATENT DOCUMENTS

| | | | | |
|---|---|---|---|---|
| JP | H11-061149 | A | 3/1999 | |
| KR | 10-0311754 | B1 | 11/2001 | |
| KR | 10-2009-0028173 | A | 3/2009 | |
| KR | 101916404 | B1 * | 11/2018 | ..... B01J 8/18 |
| KR | 10-2021-0057722 | A | 5/2021 | |

OTHER PUBLICATIONS

KR101916404B1 English Translation (Year: 2018).*
International Search Report for the International Application No. PCT/KR2022/016038 issued by the International Searching Authority (Korean Patent Office) on Feb. 6, 2023.
Ki-Bum Park et al., Production of clean oil with low levels of chlorine and olefins in a continuous two-stage pyrolysis of a mixture of waste low-density polyethylene and polyvinyl chloride, Energy, Aug. 15, 2018, pp. 402-411, vol. 157, Elsevier.
Extended European Search Report for European Patent Application No. 22884064.1 issued by the European Patent Office on Dec. 3, 2024.

* cited by examiner

*Primary Examiner* — Ellen M Mcavoy
*Assistant Examiner* — Chantel Graham
(74) *Attorney, Agent, or Firm* — IP & T GROUP LLP

(57) ABSTRACT

The present invention provides a method for producing waste plastic pyrolysis oil, the method comprising: a pyrolysis process of producing pyrolysis gas by introducing waste plastic into a pyrolysis reactor; and a hardening process of producing pyrolysis oil by injecting the pyrolysis gas into a hot filter filled with a neutralizer, wherein the pyrolysis oil contains, on the basis of the total weight, 50% by weight or more of naphtha having a boiling point of 150° C. or less and kero having a boiling point of 150° C. to 265° C. and less than 100 ppm of chlorine.

18 Claims, No Drawings

PYROLYSIS METHOD FOR WASTE PLASTIC

This application is a national stage application of PCT/KR2022/016038 filed on Oct. 20, 2022, which claims priority of Korean patent application number 10-2021-0140266 filed on Oct. 20, 2021. The disclosure of each of the foregoing applications is incorporated herein by reference in its entirety.

TECHNICAL FIELD

The present invention relates to a pyrolysis method for waste plastics.

BACKGROUND ART

Since oil (waste oil) produced through cracking and pyrolysis reactions of waste materials, such as waste plastic pyrolysis oil, contains a large amount of impurities caused by the waste materials, there is a risk of emission of air pollutants such as SOx and NOx when the oil is used as fuel, and in particular, a Cl component is converted into HCl, which has a risk of causing device corrosion during a high-temperature treatment process, and is discharged.

In the related art, Cl was removed through post-treatment processes such as a hydrotreating (HDT) process and a Cl treating process using a refinery technique. However, since waste oil such as waste plastic pyrolysis oil has a high content of Cl, problems such as equipment corrosion, abnormal reactions, and deterioration of product properties caused by an excessive amount of HCl produced in the HDT process have been reported. It is difficult to introduce non-pretreated waste oil into the HDT process. In order to remove Cl oil using the conventional refinery process, there is a need for a Cl reduction treatment technique for reducing a content of Cl in waste oil to a level that may be introduced into the refinery process.

In addition, there is a need to develop a technique related to high-value-addition of waste plastic pyrolysis oil, including yield improvement, lightening, color/odor removal, and the like, in addition to the removal of impurities.

DISCLOSURE

Technical Problem

An object of the present invention is to provide high-value-added pyrolysis oil by lightening and reducing impurities in waste plastic pyrolysis oil containing a large amount of impurities without performing a post-treatment process, and to provide process simplification of a pyrolysis oil production process.

Technical Solution

In one general aspect, a method for producing waste plastic pyrolysis oil includes: a pyrolysis process of producing pyrolysis gas by introducing waste plastics into a pyrolysis reactor; and a lightening process of producing pyrolysis oil by introducing the pyrolysis gas into a hot filter filled with a neutralizing agent, wherein the pyrolysis oil contains 50 wt % or more of naphtha having a boiling point of 150° C. or lower and kero having a boiling point of 150 to 265° C., and less than 100 ppm of chlorine, with respect to the total weight of the pyrolysis oil.

The pyrolysis process may be performed at a temperature of 400 to 550° C. in a non-oxidizing atmosphere.

The waste plastics may contain 100 to 1,000 ppm of chlorine with respect to the total weight of the waste plastics.

The lightening process may be performed at a temperature of 400 to 550° C. and a pressure of normal pressure to 0.5 bar in an oxygen-free atmosphere.

The neutralizing agent may include at least one selected from calcium oxide, a waste FCC catalyst, and a copper compound.

The hot filter may have an L/D ratio (a ratio of length/inner diameter) of 5 to 20.

The hot filter may have a $D/D_{50}$ ratio (inner diameter of hot filter/average particle size of neutralizing agent) of 10 to 200.

The neutralizing agent may be included in the hot filter in an amount of 10 to 50 vol %.

The hot filter may include an internal temperature sensor.

The lightening process may satisfy the following Relational Expressions 1 and 2.

$$50<(A_2-A_1)/A_1(\%)<100 \quad \text{[Relational Expression 1]}$$

$$-100<(B_2-B_1)/B_1(\%)<-50 \quad \text{[Relational Expression 2]}$$

In Relational Expression 1, $A_1$ represents a total amount (wt %) of naphtha having a boiling point of 150° C. or lower and kero having a boiling point of 150 to 265° C. in the pyrolysis gas, and $A_2$ represents a total amount (wt %) of naphtha having a boiling point of 150° C. or lower and kero having a boiling point of 150 to 265° C. in the pyrolysis oil, and in Relational Expression 2, $B_1$ represents a content (ppm) of chlorine in the pyrolysis gas, and $B_2$ represents a content (ppm) of chlorine in the pyrolysis oil.

The pyrolysis process and the lightening process may satisfy the following Relational Expression 3.

$$0.7<T_2/T_1<1.3 \quad \text{[Relational Expression 3]}$$

In Expression 3, $T_1$ and $T_2$ are temperatures at which the pyrolysis process and the lightening process are performed, respectively.

The pyrolysis gas may contain 5 to 35 wt % of naphtha having a boiling point of 150° C. or lower, 10 to 60 wt % of kero having a boiling point of 150 to 265° C., 20 to 40 wt % of LGO having a boiling point of 265 to 380° C., and 5 to 40 wt % of UCO-2/AR having a boiling point of 380° C. or higher, with respect to the total weight of the pyrolysis gas.

The pyrolysis oil may contain 30 to 50 wt % of naphtha having a boiling point of 150° C. or lower, 30 to 50 wt % of kero having a boiling point of 150 to 265° C., 10 to 30 wt % of LGO having a boiling point of 265 to 380° C., and 0 to 10 wt % of UCO-2/AR having a boiling point of 380° C. or higher, with respect to the total weight of the pyrolysis oil.

Advantageous Effects

As set forth above, in the present invention, pyrolysis oil may be lightened to a significantly high level without performing an additional post-treatment process after pyrolyzing waste plastic feedstock, and at the same time, pyrolysis oil having a low content of impurities applicable to the refinery process may be produced.

BEST MODE

Unless defined otherwise, all terms (including technical and scientific terms) used in the present specification have the same meanings as commonly understood by those skilled in the art to which the present invention pertains. Throughout the specification, unless explicitly described to the contrary, "comprising" any components will be understood to imply further inclusion of other components rather than the exclusion of any other components. In addition, singular forms are intended to include plural forms, unless the context clearly indicates otherwise.

In the present specification, "A to B" means "A or more and B or less", unless defined otherwise.

In addition, "A and/or B" means at least one selected from the group consisting of A and B, unless defined otherwise.

In the present specification, a boiling point used without special mention is based on 1 atmosphere and includes an expression such as a boiling point or bp.

One embodiment of the present invention provides a method for producing waste plastic pyrolysis oil. The method includes a pyrolysis process of producing pyrolysis gas by introducing waste plastics into a pyrolysis reactor, and a lightening process of producing pyrolysis oil by introducing the pyrolysis gas into a hot filter filled with a neutralizing agent, wherein the pyrolysis oil contains 50 wt % or more of naphtha having a boiling point of 150° C. or lower and kero having a boiling point of 150 to 265° C., and less than 100 ppm of chlorine, with respect to the total weight of the pyrolysis oil. Accordingly, in the present invention, pyrolysis oil may be lightened to a significantly high level without performing an additional post-treatment process after pyrolyzing waste plastic feedstock, and at the same time, chlorine may be removed. The produced pyrolysis oil may contain naphtha having a boiling point of 150° C. or lower and kero having a boiling point of 150 to 265° C. in an amount of, preferably 60 wt % or more, and more preferably, 70 wt % or more, with respect to the total weight of the pyrolysis oil, and may contain chlorine in an amount of, preferably less than 60 ppm, and more preferably, less than 50 ppm, with respect to the total weight of the pyrolysis oil.

The pyrolysis process is a process of introducing waste plastics into a pyrolysis reactor and heating the waste plastics to produce pyrolysis gas. The pyrolysis process may be performed at a temperature of 400 to 550° C. in a non-oxidizing atmosphere, and specifically, the non-oxidizing atmosphere is an atmosphere in which waste plastics do not oxidize (combust), and may be, for example, an atmosphere in which an oxygen concentration is adjusted to 1 vol % or less, or an atmosphere of an inert gas such as nitrogen, water vapor, carbon dioxide, or argon. When the pyrolysis temperature is 400° C. or higher, fusion of chlorine-containing plastics may be prevented, and when the pyrolysis temperature is 550° C. or lower, chlorine in waste plastics may partially remain in a pyrolysis residue (char), which is preferable.

In the pyrolysis process, a pyrolysis gas phase, a pyrolysis liquid phase including oil and wax, and a pyrolysis solid phase including a pyrolysis residue may be produced. In the pyrolysis process, pyrolysis may be performed in the above range to recover the pyrolysis gas phase and the pyrolysis liquid phase as gas.

The waste plastics may include at least one selected from the group consisting of polyethylene (PE), polypropylene (PP), polyethylene terephthalate (PET), polyvinyl chloride (PVC), and polystyrene (PS). The waste plastics may contain organic chlorine (organic Cl) and inorganic chlorine (organic Cl). Waste oil produced through cracking and pyrolysis reactions of waste plastics, such as waste plastic pyrolysis oil, contains a large amount of impurities derived from waste plastics. Accordingly, there is a concern about emission of air pollutants when using waste oil, and in particular, organic chlorine and inorganic chlorine components are converted into HCl and discharged during a high-temperature treatment process, and thus, it is required to pretreat the waste oil to remove the impurities such as the chlorine components.

The waste plastics of the present invention may contain 100 to 1,000 ppm of chlorine with respect to the total weight of the waste plastics.

In general, waste plastics may be divided into domestic waste plastic and industrial waste plastic. The domestic waste plastic is a plastic in which PVC, PS, PET, PBT, and the like in addition to PE and PP are mixed, and may refer to a mixed waste plastic containing 3 wt % or more of PVC together with PE and PP in the present invention. A content of chlorine in the waste plastics is relatively high, for example, 5,000 ppm or more or 5,000 to 15,000 ppm. PE/PP accounts for most industrial waste plastic, and a content of chlorine in the industrial waste plastic is 100 to 1,000 ppm, 500 to 1,000 ppm, or 700 to 1,000 ppm, which is lower than the content of chlorine in the domestic waste plastic. However, in the industrial waste plastic, a content of organic Cl originating from an adhesive or a dye component is high, and in particular, a proportion of chlorine contained in an aromatic ring is high.

In particular, chlorine originating from PVC in the domestic waste plastic is removed with HCl (hydrogen chloride elimination), whereas chlorine from PE and PP, which account for most industrial waste plastic, originates from an adhesive or a dye component. In most cases, organic chlorine derived from the aromatic ring has a higher proportion than organic chlorine formed at the end of the chain ring and is difficult to remove by general pyrolysis or a neutralizing agent.

The pyrolysis gas produced in the pyrolysis process may contain, with respect to the total weight of the pyrolysis gas, 5 to 35 wt % of naphtha having a boiling point of 150° C. or lower, 10 to 60 wt % of kero having a boiling point of 150 to 265° C., 20 to 40 wt % of LGO having a boiling point of 265 to 380° C., and 5 to 40 wt % of UCO-2/AR having a boiling point of 380° C. or higher, and specifically, 5 to 30 wt % of naphtha having a boiling point of 150° C. or lower, 15 to 50 wt % of kero having a boiling point of 150 to 265° C., 20 to 35 wt % of LGO having a boiling point of 265 to 380° C., and 10 to 40 wt % of UCO-2/AR having a boiling point of 380° C. or higher, or 5 to 20 wt % of naphtha having a boiling point of 150° C. or lower, 15 to 35 wt % of kero having a boiling point of 150 to 265° C., 25 to 35 wt % of LGO having a boiling point of 265 to 380° C., and 15 to 40 wt % of UCO-2/AR having a boiling point of 380° C. or higher. In addition, in the pyrolysis gas, a weight ratio of light oils (the sum of naphtha and kero) to heavy oils (the sum of LGO and UCO-2/AR) may be 0.1 to 3, 0.1 to 2.0, or 0.2 to 1.0. When the pyrolysis gas having the above range of the oil composition is then introduced into a hot filter of the present invention, the desired effect of lightening pyrolysis oil and removing impurities may be improved. Specifically, in the hot filter, as a pyrolysis reaction occurs primarily at a high temperature, additional chlorine dissociation and lightening of oil proceed simultaneously, and secondarily, the dissociated chlorine comes into contact with a neutralizing agent (CaO) and is fixed in the form of salt. In particular, it is analyzed that the amount of HCl generated is large in pyrolysis oil derived from domestic waste plastic including PVC, and the HCl dissociated chlorine is not recombined with hydrocarbons and is fixed to the neutralizing agent (CaO) in the hot filter at a high ratio. Accordingly, the method for producing pyrolysis oil of the present invention may have better chlorine removal efficiency when using domestic waste plastic as a feedstock. However, in the case of industrial waste plastic, the chlorine removal efficiency may be somewhat low because the content of chlorine in the feedstock itself is lower than that of domestic waste plastic, but the lightening effect may be significantly improved due to a difference in the composition of waste plastics.

The pyrolysis reactor may be an autoclave reactor, a batch stirred reactor, a fluidized-bed reactor, a packed-bed reactor, or the like, and specifically, any reactor capable of controlling stirring and temperature rise may be applied. In the present invention, the pyrolysis process may be performed in a batch reactor.

Meanwhile, as described above, in the pyrolysis process, a pyrolysis gas phase, a pyrolysis liquid phase including oil and wax, and a pyrolysis solid phase including a pyrolysis residue may be produced. In the pyrolysis process, pyrolysis may be performed in the above temperature range to recover the pyrolysis gas phase and the pyrolysis liquid phase as gas.

The pyrolysis process may further include a separation process of separating the pyrolysis solid phase (solids) into fine particles and coarse particles. In the separation process, solids in the solid phase generated in the pyrolysis process, for example, carbides, a neutralizing agent, and/or copper compounds are separated into fine particles and coarse particles. Specifically, classification is performed using a sieve having a size smaller than an average particle diameter of the chlorine-containing plastics and larger than an average particle diameter of the neutralizing agent or the copper compound, such that the solids generated by the pyrolysis reaction may be separated into fine particles and coarse particles. In the separation process, it is preferable to separate the solids into fine particles containing a relatively large amount of the chlorine-containing neutralizing agent and the copper compound, and coarse particles containing a relatively large amount of carbides. The fine particles and carbides may be retreated as necessary, reused in the pyrolysis process, used as fuel, or disposed of as waste, but the present invention is not limited thereto.

In the pyrolysis process, pyrolysis gas containing low-boiling hydrocarbon compounds such as methane (CH4), ethane (C2H6), and propane (C3H8) in the generated gas phase may be separately recovered. The pyrolysis gas generally contains combustible materials such as hydrogen, carbon monoxide, and low-molecular-weight hydrocarbon compounds. Examples of the hydrocarbon compounds include methane, ethane, ethylene, propane, propene, butane, and butene. Such pyrolysis gas contains a combustible material and may be used as fuel.

Subsequently, in the lightening process, the produced pyrolysis gas is introduced into a hot filter filled with a neutralizing agent to produce pyrolysis oil.

The lightening process may be performed at a temperature of 400 to 550° C. and a pressure of normal pressure to 0.5 bar in an oxygen-free atmosphere, and the oxygen-free atmosphere may be an inert gas atmosphere or a closed system atmosphere without oxygen. In the temperature range of the lightening process (hot filter), the lightening of the pyrolysis gas is performed well, such that clogging and a differential pressure caused by wax may be solved, which is preferable.

In the lightening process, a gas volumetric flow rate (GHSV) may be 0.3 to 1.2/hr or 0.5 to 0.8/hr. Accordingly, it is possible to lighten waste plastic pyrolysis products and reduce impurities (Cl and the like) without performing a post-treatment process, and light oil desired in the present invention may be produced by adjusting the retention time (GHSV) of the pyrolysis gas.

The neutralizing agent may be oxide, hydroxide, and carbonate of a metal, or a combination thereof, and the metal may be calcium, aluminum, magnesium, zinc, iron, copper, or a combination thereof. Specifically, the neutralizing agent may be aluminum oxide, calcium oxide, magnesium oxide, zinc oxide, iron oxide, and/or copper oxide. In addition, the neutralizing agent may be a zeolite component such as a waste fluid catalytic cracking (FCC) catalyst (E-cat), and may further contain a waste FCC catalyst in the metal oxide. Preferably, the neutralizing agent may be calcium oxide, a waste FCC catalyst, copper metal, or copper oxide, or may be calcium oxide.

The hot filter generally serves to separate gas (pyrolysis gas) and a residue (char) among pyrolyzed products in the art. However, in the present invention, a hot filter filled with a neutralizing agent is applied not only to achieve lightening but also to reduce impurities (Cl), and therefore, as described above, operating conditions such as a temperature of the hot filter and an average particle size of the neutralizing agent are adjusted to specific ranges. In particular, as described below, considering the unique physical properties of waste plastic pyrolysis oil, which are different from petroleum oils such as existing crude oil, lightening efficiency and impurity removal efficiency may be significantly improved by using a hot filter whose L/D ratio (a ratio of length/inner diameter) and $D/D_{50}$ ratio (a ratio of inner diameter of hot filter/average particle size of neutralizing agent) satisfy certain ranges.

As the hot filter, various hot filters of a small tank reactor and a tubing type or conventionally known type may be used. In terms of improving the lightening efficiency of the pyrolysis gas produced from waste plastics, a tubing type hot filter may be preferable, but is not limited thereto.

In a case where the hot filter is a tubing type hot filter, the neutralizing agent may be filled into the tubing. A material of the tubing may be a corrosion-resistant alloy containing Cr, Mo, W, and Fe, and may be, for example, a Hastelloy-based alloy. When using carbon steel or stainless steel, safety, health, and environment (SHE) issues may arise due to corrosion caused by acidic gases such as Cl and F and acidic atmosphere generated during the pyrolysis process. The safety, health, and environment (SHE) issues may be prevented by using the Hastelloy-based alloy.

An L/D ratio (a ratio of length/inner diameter) of the hot filter does not exceed 30, and specifically, may be 5 to 20. When the L/D ratio satisfies the above range, the lightening efficiency and impurity removal efficiency may be improved. The conventional commercial process has an L/D ratio of 30 or more, resulting in a reduction in process efficiency; however, the hot filter has an L/D ratio of 5 to 20, and thus, the hot filter is optimized in terms of thermal insulation and heat transfer, and the lightening efficiency and impurity removal efficiency may be significantly improved. The L/D ratio may be preferably 5 to 15 and more preferably 7 to 13.

Meanwhile, the average particle size of the neutralizing agent may refer to $D_{50}$, and $D_{50}$ refers to a particle diameter when a cumulative volume from a small particle size accounts for 50% in measuring a particle size distribution by a laser scattering method. In this case, as for $D_{50}$, the particle size distribution may be measured by collecting the sample from the prepared carbonaceous material according to KS A ISO 13320-1 standard using Mastersizer 3000 manufactured by Malvern Panalytical Ltd. Specifically, ethanol may be used as a solvent, and if necessary, the ethanol is dispersed using an ultrasonic disperser, and then, a volume density may be measured.

The hot filter may have a $D/D_{50}$ ratio (a ratio of inner diameter of hot filter/average particle size of neutralizing agent) of 10 to 200. When the pyrolysis gas passes through a hot filter that satisfies the $D/D_{50}$ ratio, the process efficiency may be improved as a wall effect that affects a flow rate is minimized and transmission efficiency is optimized. Accordingly, the lightening efficiency and impurity removal efficiency may be significantly improved. The $D/D_{50}$ ratio may be preferably 20 to 160 and more preferably 30 to 120.

Specifically, the average particle size of the neutralizing agent may be 400 to 900 μm. Under the operating conditions of the lightening process of the present invention, the hot filter is filled with a neutralizing agent having the above-described average particle size and the residence time (GHSV) of the pyrolysis gas is thus adjusted, such that the lightening of the oil may be achieved, and at the same time, a plugging phenomenon that occurs during the process operation may be minimized. Accordingly, a differential pressure of the hot filter may be suppressed, resulting in improvement of the process operation efficiency. Specifically, the average particle size of the neutralizing agent may be 500 to 800 μm, and more specifically, may be 500 to 700 μm.

The neutralizing agent may be included in the hot filter in an amount of 10 to 50 vol %. A content of the neutralizing agent to be included in the hot filter may vary depending on a volume and feed of the hot filter, and as the neutralizing agent is included in the above range, dozens of continuous processes are possible, and thus, the process efficiency may be maximized. Specifically, the neutralizing agent may be included in an amount of 10 to 40 vol %. In this case, the remaining components other than the neutralizing agent may be inorganic beads, for example, glass beads.

Considering the specifications of the hot filter in detail, an inner diameter may be 1 to 8 cm, an outer diameter may be 2 to 10 cm, and a thickness may be 0.1 to 1 cm. As the above ranges are satisfied, the lightening efficiency and impurity removal efficiency may be improved. Specifically, the inner diameter may be 2 to 8 cm, the outer diameter may be 4 to 8 cm, and the thickness may be 0.2 to 0.8 cm, and more specifically, the inner diameter may be 2 to 6 cm, the outer diameter may be 4 to 6 cm, and the thickness may be 0.2 to 0.6 cm.

A cross-sectional area of the hot filter may be 10 to 30 $cm^2$. Specifically, the cross-sectional area of the hot filter may be 10 to 25 $cm^2$, and more specifically, may be 15 to 25 $cm^2$.

The hot filter may include an internal temperature sensor. The internal temperature sensor may be located on the inner or outer wall of the hot filter, and may measure the temperature of the lightening process in real time and may improve the lightening efficiency by controlling the lightening reaction.

The hot filter is connected to the pyrolysis reactor so that the produced pyrolysis gas may be introduced from the pyrolysis reactor. In this case, the hot filter may be used in the form of a bench catalyst column, and the lifespan of the hot filter may be improved by being designed to allow loading/uploading.

A ratio (Vol/Feed ratio) of hot volume filter/feedstock of waste plastics exceeds 0.05, and may be 0.1 to 0.8. Since Vol/Feed is higher than Vol/Feed of less than 0.05 in the conventional commercial process, the lightening efficiency and impurity removal efficiency may be improved in the above range, and the lifespan of the hot filter may also be improved. Specifically, the Vol/Feed ratio may be 0.1 to 0.6, and more specifically, the Vol/Feed ratio may be 0.3 to 0.5.

The lightening process may satisfy the following Relational Expressions 1 and 2.

$$50<(A_2-A_1)/A_1(\%)<100 \quad \text{[Relational Expression 1]}$$

$$-100<(B_2-B_1)/B_1(\%)<-50 \quad \text{[Relational Expression 2]}$$

In Relational Expression 1, $A_1$ represents a total amount (wt %) of naphtha having a boiling point of 150° C. or lower and kero having a boiling point of 150 to 265° C. in the pyrolysis gas, and $A_2$ represents a total amount (wt %) of naphtha having a boiling point of 150° C. or lower and kero having a boiling point of 150 to 265° C. in the pyrolysis oil, and in Relational Expression 2, $B_1$ represents a content (ppm) of chlorine in the pyrolysis gas, and $B_2$ represents a content (ppm) of chlorine in the pyrolysis oil.

Specifically, Relational Expressions 1 and 2 may be $60<(A_2-A_1)/A_1$ (%)<90, $65<(A_2-A_1)/A_1$ (%)<85, or $70<(A_2-A_1)/A_1$ (%)<80, and $-75<(B_2-B_1)/B_1$ (%)<−55, $-70<(B_2-B_1)/B_1$ (%)<−55, or $-65<(B_2-B_1)/B_1$ (%)<−55, respectively.

Relational Expressions 1 and 2 numerically represent degrees of lightness and heaviness of the waste plastic pyrolysis product as the hot filter filled with the neutralizing agent of the present invention is used. The present invention has a technical feature in that the degree of lightness of the pyrolysis oil is improved to a significantly high level by controlling the oil composition and the content of chlorine of the pyrolysis gas introduced into the hot filter and the organic/inorganic materials containing chlorine.

The pyrolysis oil produced in the lightening process may contain, with respect to the total weight of the pyrolysis oil, 30 to 50 wt % of naphtha having a boiling point of 150° C. or lower, 30 to 50 wt % of kero having a boiling point of 150 to 265° C., 10 to 30 wt % of LGO having a boiling point of 265 to 380° C., and 0 to 10 wt % of UCO-2/AR having a boiling point of 380° C. or higher, and specifically, 35 to 50 wt % of naphtha having a boiling point of 150° C. or lower, 35 to 50 wt % of kero having a boiling point of 150 to 265° C., 10 to 30 wt % of LGO having a boiling point of 265 to 380° C., and 0 to 8 wt % of UCO-2/AR having a boiling point of 380° C. or higher, or 35 to 45 wt % of naphtha having a boiling point of 150° C. or lower, 35 to 45 wt % of kero having a boiling point of 150 to 265° C., 10 to 20 wt % of LGO having a boiling point of 265 to 380° C., and 0 to 6 wt % of UCO-2/AR having a boiling point of 380° C. or higher. In addition, in the pyrolysis gas, a weight ratio of light oils (the sum of naphtha and kero) to heavy oils (the sum of LGO and UCO-2/AR) may be 2.5 to 5, 2.5 to 4, or 3 to 3.8.

In the method for producing waste plastic pyrolysis oil according to one embodiment of the present invention, the pyrolysis process and lightening and chlorine fixing processes may satisfy the following Relational Expression 1.

$$0.7<T_2/T_1<1.3 \quad \text{[Relational Expression 3]}$$

In Expression 3, $T_1$ and $T_2$ are temperatures at which the pyrolysis process and the lightening process (and chlorine fixing) are performed, respectively.

In a case where the pyrolysis process and the lightening process are performed so that the $T_2/T_1$ value satisfies 0.7 or less, the temperature of the pyrolysis process may be relatively high, or the temperature of the lightening process (and chlorine fixing) may be relatively low. In this case, a ratio of pyrolysis oil that is condensed in the hot filter and then circulated to the pyrolysis reactor increases, and thus, a final boiling point of the pyrolysis oil may be excessively low. On the other hand, in a case where the above processes are performed so that the $T_2/T_1$ value satisfies 1.3 or more, a loss ratio of the pyrolysis oil in a gas phase may excessively increase, and thus, the yield of the pyrolysis oil may be reduced. When the $T_2/T_1$ value satisfies a range of 0.7 to 1.3, the degree of lightness may be significantly improved. Specifically, $T_2/T_1$ may be, for example, 0.7 to 1.2, 0.8 to 1.2, 0.8 to 1.1, 0.9 to 1.1, or 1.

The method for producing waste plastic pyrolysis oil according to one embodiment of the present invention may further include, before the pyrolysis process, a pretreatment process for waste plastics. In addition, the pretreatment process may further include a process of introducing waste plastics into a screw reactor and crushing the waste plastics at room temperature, but the present invention is not limited thereto.

Hereinafter, preferred Examples and Comparative Examples of the present invention will be described. However, each of the following Examples is merely a preferred example of the present invention, and the present invention is not limited to the following Examples.

EXAMPLES

Example 1

3 Kg of industrial waste vinyl was introduced into a batch pyrolysis reactor, and pyrolysis was performed at 500° C. The industrial waste vinyl used was waste vinyl from duty-free shops and was mostly PE/PP, and the total content of Cl was 853 ppm.

The pyrolysis gas produced through the pyrolysis was introduced into a bench catalyst column including a Cao filter, passed through a condenser, and then recovered as liquid pyrolysis oil in a recovery section. In this case, as the CaO filter, a Cao filter formed of Hastelloy HC-276 material and having an inner diameter of 5.4 cm and a length of 53 cm was used. Considering the differential pressure at the front and rear ends, 40 g of Cao having an average particle size ($D_{50}$) of 500 μm was filled, and the filter was maintained at 500° C., which was the same as the pyrolysis reaction temperature.

Example 2

Pyrolysis oil was obtained in the same manner as in Example 1, except that a Cao filter formed of Hastelloy HC-276 material and having an inner diameter of 5.4 cm and a length of 200 cm was used.

Example 3

Pyrolysis oil was obtained in the same manner as in Example 1, except that a Cao filter filled with a neutralizing agent having an average particle size of 8,000 μm was used.

Example 4

A reaction was performed in the same manner as in Example 1, except that pyrolysis was performed by setting the temperature of the pyrolysis reactor to 400° C., and the temperature when the pyrolysis gas passed through the Cao filter was set to 600° C.

Example 5

A reaction was performed in the same manner as in Example 1, except that pyrolysis was performed by setting the temperature of the pyrolysis reactor to 600° C., and the temperature when the pyrolysis gas passed through the Cao filter was set to 400° C.

Comparative Example 1

Pyrolysis oil was obtained in the same manner as in Example 1, except that the CaO filter was not used, and the pyrolysis gas produced through pyrolysis passed directly through the condenser.

Evaluation Example: Analysis of Pyrolysis Oil Lightening Results and Impurity Reduction Results in Pyrolysis Oil GC-Simdis analysis (HT 750) was performed to confirm the boiling point distribution in the waste plastic pyrolysis oil prepared in each of Examples 1 to 5 and Comparative Example 1, and ICP, TNS, EA-O, and XRF analysis were performed to analyze the content of impurity Cl.

First, the analysis results of the content of impurity Cl are shown in Table 1.

TABLE 1

| | Example 1 | Example 2 | Example 3 | Example 4 | Example 5 | Comparative Example 1 |
|---|---|---|---|---|---|---|
| L/D | 9.8 | 37 | 9.8 | 9.8 | 9.8 | — |
| $D/D_{50}$ | 108 | 108 | 6.8 | 108 | 108 | — |
| $T_2/T_1$ | 1 | 1 | 1 | 1.5 | 0.6 | — |
| Total Cl in Feed [ppm] | 853 | 853 | 853 | 853 | 853 | 853 |
| Total Cl in Gas [ppm] | 325 | 325 | 325 | 377 | 282 | 325 |
| Total Cl in Oil [ppm] | 42 | 92 | 90 | 97 | 87 | 310 |

In Table 1, in the cases of Examples 1 to 5 in which the CaO Filter was applied, it was confirmed that the total content of chlorine in the pyrolysis oil was effectively reduced to 100 ppm or less.

In particular, in the case of Example 1, the total content of chlorine in the pyrolysis oil was reduced to 42 ppm or less, and it was confirmed that the chlorine removal effect was significantly excellent. On the other hand, in Example 2, the total content of chlorine was 92 ppm as the L/D ratio deviated from 5 to 20 of the present invention, and in Example 3, the total content of chlorine was reduced to 90 ppm as the $D/D_{50}$ ratio deviated from 10 to 200 of the present invention. As a result, it was confirmed that the chlorine removal effect was somewhat lower than that of Example 1.

In addition, in each of Examples 4 and 5, as $T_2/T_1$ deviated from 0.7 to 1.3 of the present invention, the total contents of chlorine were reduced to 97 ppm and 87 ppm, respectively. As a result, it was confirmed that the chlorine removal effect was somewhat lower than that of Example 1.

In the case of Comparative Example 1, the total content of chlorine was 310 ppm, and thus, it was confirmed that the chlorine removal effect was significantly reduced by a simple pyrolysis process without using a Cao filter.

In addition, GC-Simdis analysis (HT 750) was performed to confirm the boiling point distribution in the produced waste plastic pyrolysis oil, and the results were shown in Table 2.

TABLE 2

| | Example 1 | Example 2 | Example 3 | Example 4 | Example 5 | Comparative Example 1 |
|---|---|---|---|---|---|---|
| L/D | 9.8 | 37 | 9.8 | 9.8 | 9.8 | — |
| $D/D_{50}$ | 108 | 108 | 6.8 | 108 | 108 | — |
| $T_2/T_1$ | 1 | 1 | 1 | 1.5 | 0.6 | — |
| Naphtha in Oil (IBP to 150° C.) | 39.3 | 24.7 | 24.2 | 23.5 | 19.2 | 15.8 |
| Kerosene in Oil (150 to 265° C.) | 37.9 | 29.5 | 29.6 | 34.3 | 31.7 | 26.1 |
| LGO in Oil (265 to 380° C.) | 17.9 | 21.4 | 23.1 | 22.5 | 29.6 | 26.8 |
| UCO-2/AR in Oil (380° C. or higher) | 4.4 | 24.1 | 22.5 | 20.4 | 19.2 | 31 |
| Sum | 99.5 | 99.7 | 99.4 | 99.7 | 99.7 | 99.7 |
| Naph + KERO in Gas [wt %] | 40.9 | 36.5 | 37.2 | 38.1 | 38.4 | 41.5 |
| Naph + KERO in Oil [wt %] | 77.2 | 54.2 | 53.8 | 57.8 | 50.9 | 41.9 |

As shown in Table 2, in the cases of Examples 1 to 5 in which the CaO filter was applied, the total weight of naphtha having a boiling point of 150° C. or lower and kero having a boiling point of 150 to 265° C. was 50%, and thus, it was confirmed that the lightening effect was excellent.

In particular, in the case of Example 1, the total weight of naphtha and kero was 77.2%, and thus, it was confirmed that the lightening effect was significantly excellent. On the other hand, in Example 2, the total weight of naphtha and kero was 54.2%, and the L/D ratio deviated from 5 to 20 of the present invention, and in Example 3, the total weight of naphtha and kero was 53.8%, and the $D/D_{50}$ ratio deviated from 10 to 200 of the present invention. As a result, it was confirmed that the lightening effect was somewhat lower than that of Example 1, but was superior to that of Comparative Example 1.

In addition, also in Examples 4 and 5, the total weights of naphtha and kero were 57.8% and 50.9%, respectively, and $T_2/T_1$ deviated from 0.7 to 1.3 of the present invention. As a result, it was confirmed that the lightening effect was somewhat lower than that of Example 1, but was superior to that of Comparative Example 1.

In the case of Comparative Example 1, the total weight of naphtha and kero was 41.9%, and it was confirmed that the lightening effect was significantly reduced by a simple pyrolysis process without using a CaO filter.

Although embodiments of the present invention have been described, the present invention is not limited to the embodiments, but may be prepared in various different forms, and it will be apparent to those skilled in the art to which the present invention pertains that the embodiments may be implemented in other specific forms without departing from the spirit or essential feature of the present invention. Therefore, it is to be understood that the embodiments described hereinabove are illustrative rather than restrictive in all aspects.

The invention claimed is:

1. A method for producing waste plastic pyrolysis oil, the method comprising:

a pyrolysis process of producing pyrolysis gas by introducing waste plastics into a pyrolysis reactor at a temperature of 400 to 550° C.; and a lightening process of producing pyrolysis oil by directly introducing the pyrolysis gas into a hot filter filled with a neutralizing agent, wherein the pyrolysis oil contains 50 wt % or more of naphtha having a boiling point of 150° C. or lower and kero having a boiling point of 150 to 265° C., and less than 100 ppm of chlorine, with respect to the total weight of the pyrolysis oil.

2. The method of claim 1, wherein the pyrolysis process is performed in a non-oxidizing atmosphere.

3. The method of claim 1, wherein the waste plastics contain 100 to 1,000 ppm of chlorine with respect to the total weight of the waste plastics.

4. The method of claim 1, wherein the lightening process is performed at a temperature of 400 to 550° C. and a pressure of normal pressure to 0.5 bar in an oxygen-free atmosphere.

5. The method of claim 1, wherein the neutralizing agent includes at least one selected from calcium oxide, a waste FCC catalyst, and a copper compound.

6. The method of claim 1, wherein the hot filter has an L/D ratio of 5 to 20, wherein L is a length of the hot filter and D is an inner diameter of the hot filter.

7. The method of claim 1, wherein the hot filter has a $D/D_{50}$ ratio of 10 to 200, wherein D is an inner diameter of the hot filter and $D_{50}$ is an average particle size of neutralizing agent.

8. The method of claim 1, wherein the neutralizing agent is included in the hot filter in an amount of 10 to 50 vol %.

9. The method of claim 1, wherein the hot filter includes an internal temperature sensor.

10. The method of claim 1, wherein the lightening process satisfies the following Relational Expressions 1 and 2:

$$50<(A_2-A_1)/A_1\ (\%)<100 \quad \text{[Relational Expression 1]}$$

$$-100<(B_2-B_1)/B_1)\ (\%)<-50 \quad \text{[Relational Expression 2]}$$

in Relational Expression 1, $A_1$ represents a total amount (wt %) of naphtha having a boiling point of 150° C. or lower and kero having a boiling point of 150 to 265° C. in the pyrolysis gas, and $A_2$ represents a total amount (wt %) of naphtha having a boiling point of 150° C. or lower and kero having a boiling point of 150 to 265° C. in the pyrolysis oil, and in Relational Expression 2, $B_1$ represents a content (ppm) of chlorine in the pyrolysis gas, and $B_2$ represents a content (ppm) of chlorine in the pyrolysis oil.

11. The method of claim 1, wherein the pyrolysis process and the lightening process satisfy the following Relational Expression 3:

$$0.7<T_2/T_1<1.3 \quad \text{[Relational Expression 3]}$$

in Expression 3, $T_1$ and $T_2$ are temperatures at which the pyrolysis process and the lightening process are performed, respectively.

12. The method of claim 1, wherein the pyrolysis gas contains 5 to 35 wt % of naphtha having a boiling point of 150° C. or lower, 10 to 60 wt % of kero having a boiling point of 150 to 265° C., 20 to 40 wt % of LGO having a boiling point of 265 to 380° C., and 5 to 40 wt % of UCO-2/AR having a boiling point of 380° C. or higher, with respect to the total weight of the pyrolysis gas.

13. The method of claim 1, wherein the pyrolysis oil contains 30 to 50 wt % of naphtha having a boiling point of 150° C. or lower, 30 to 50 wt % of kero having a boiling point of 150 to 265° C., 10 to 30 wt % of LGO having a boiling point of 265 to 380° C., and 0 to 10 wt % of UCO-2/AR having a boiling point of 380° C. or higher, with respect to the total weight of the pyrolysis oil.

14. The method of claim 2, wherein the non-oxidizing atmosphere includes an oxygen concentration of 1 vol % or less.

15. The method of claim 1, wherein the pyrolysis gas includes, with respect to the total weight of the pyrolysis gas, 5 to 35 wt % of naphtha having a boiling point of 150° C. or lower, 10 to 60 wt % of kero having a boiling point of 150 to 265° C., 20 to 40 wt % of LGO having a boiling point of 265 to 380° C., and 5 to 40 wt % of UCO-2/AR having a boiling point of 380° C. or higher.

16. The method of claim 1, wherein a gas volumetric flow rate (GHSV) in the lightening process is 0.5 to 0.8/hr.

17. The method of claim 1, wherein the neutralizing agent comprises a waste fluid catalytic cracking (FCC) catalyst, copper metal, or copper oxide.

18. The method of claim 1, wherein a ratio of volume of the hot filter to feed of waste plastics is 0.1 to 0.8.

* * * * *